US005303849A

United States Patent [19]

Credle, Jr.

[11] Patent Number: 5,303,849

[45] Date of Patent: Apr. 19, 1994

[54] LEVER ARM ASSEMBLY FOR A BEVERAGE DISPENSING VALVE

[75] Inventor: William S. Credle, Jr., Stone Mountain, Ga.

[73] Assignee: The Coca-Cola Company, Atlanta, Ga.

[21] Appl. No.: 66,954

[22] Filed: May 24, 1993

[51] Int. Cl.[5] ..... B67D 5/56

[52] U.S. Cl. ..... 222/129.1; 137/607; 222/504

[58] Field of Search ..... 222/129.1-129.4, 222/504, 505; 137/607; 251/243, 231, 291

[56] References Cited

U.S. PATENT DOCUMENTS

| | | | |
|---|---|---|---|
| 4,660,748 | 4/1987 | Hagan | 251/291 X |
| 4,741,355 | 5/1988 | Credle, Jr. et al. | 137/607 X |
| 5,014,963 | 5/1991 | Nakayama et al. | 251/291 X |
| 5,129,549 | 7/1992 | Austin | 222/129.1 |

OTHER PUBLICATIONS

Photographs of McCann Turbo Flow Valve Dispensing Arm.

*Primary Examiner*—Gregory L. Huson

*Attorney, Agent, or Firm*—Thomas R. Boston; Lynne R. O'Brien; W. Dexter Brooks

[57] ABSTRACT

A lever arm assembly for a beverage dispensing valve including a valve including a housing including a cover and a bottom plate, a switch means inside said cover for turning on said valve to dispense a drink, a lever arm chamber for receiving a lever arm and said lever arm connected to said valve and being movable between a rest position in which the switch means is actuated and an actuating position in which said switch means is actuated, and means for holding said lever arm in a rest position. The lever arm including a cup contacting portion extending down below said valve, a pivot pin and a switch actuating portion extending above said pivot pin and into the valve housing. The housing including a lever arm opening to allow said valve actuating portion and said pivot pin to be inserted into said lever arm chamber, such that the lever arm can move freely between its rest and actuating positions, and a pivot pin recess for receiving and holding said pivot pin.

10 Claims, 4 Drawing Sheets

LEVER ARM ASSEMBLY FOR A BEVERAGE DISPENSING VALVE

BACKGROUND OF THE INVENTION

The present invention relates to a lever arm assembly for a beverage dispensing valve and more particularly to a lever arm which can be easily and quickly attached, removed and replaced without the need for tools and without disassembling the valve.

The dispense cycle of a beverage dispensing valve is typically initiated when the operator pushes a beverage selection button or pushes a cup against a lever arm activating a switch in the valve. While it is possible to switch a dispenser from a lever arm mode to a push button mode, such conversion is difficult, because the entire valve must be taken apart in order to remove the lever arm. Rather than go to the difficulty of disassembling the valve, some field technicians simply break off the lever arm rather than removing it from the valve assembly when converting a dispenser to the push button mode. In addition to the unsightly appearance the broken lever arm gives to the dispenser, the valve body can be damaged by forcibly breaking off the lever arm. A similar problem is encountered when the lever arm of the dispenser breaks during the course of normal use. In order to replace the lever arm, the entire valve must be taken apart. The resulting dispenser down time results in lost revenue for the outlet. A further problem with dispensing valves is the limited mechanical life of a microswitch. These switch mechanisms can also become clogged by syrup and dirt, resulting in dispenser down time. Accordingly there is a need in the art for an improved lever arm and switch mechanism for dispensing valves in beverage dispensers.

SUMMARY OF THE INVENTION

A lever arm assembly for a beverage dispensing valve including a valve including a housing including a cover and a bottom plate, a switch means inside said cover for turning on said valve to dispense a drink, a lever arm chamber for receiving a lever arm and said lever arm connected to said valve and being movable between a rest position in which the switch means is actuated and an actuating position in which said switch means is actuated, and means for holding said lever arm in a rest position. The lever arm including a cup contacting portion extending down below said valve, a pivot pin and a switch actuating portion extending above said pivot pin and in to said valve housing. The housing including a lever arm opening to allow said valve actuating portion and said pivot pin to be inserted into said lever arm chamber, such that the lever arm can move freely between its rest and actuating positions, and a pivot pin recess for receiving and holding said pivot pin.

The present invention is an improvement over the prior art because it utilizes a Hall Effect sensor which is not affected by syrup or dirt build-up. The Hall Effect sensor also has a virtually unlimited life compared to the limited life of a microswitch. It is known to use movable pins to hold and spread the arms of the dispensing lever; however, a sharp object or fingernails are required in order to lift the pins to remove or replace the lever arm. The prior art valve also requires the proper positioning of the lever arm in two different locations, one on each side of the valve.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
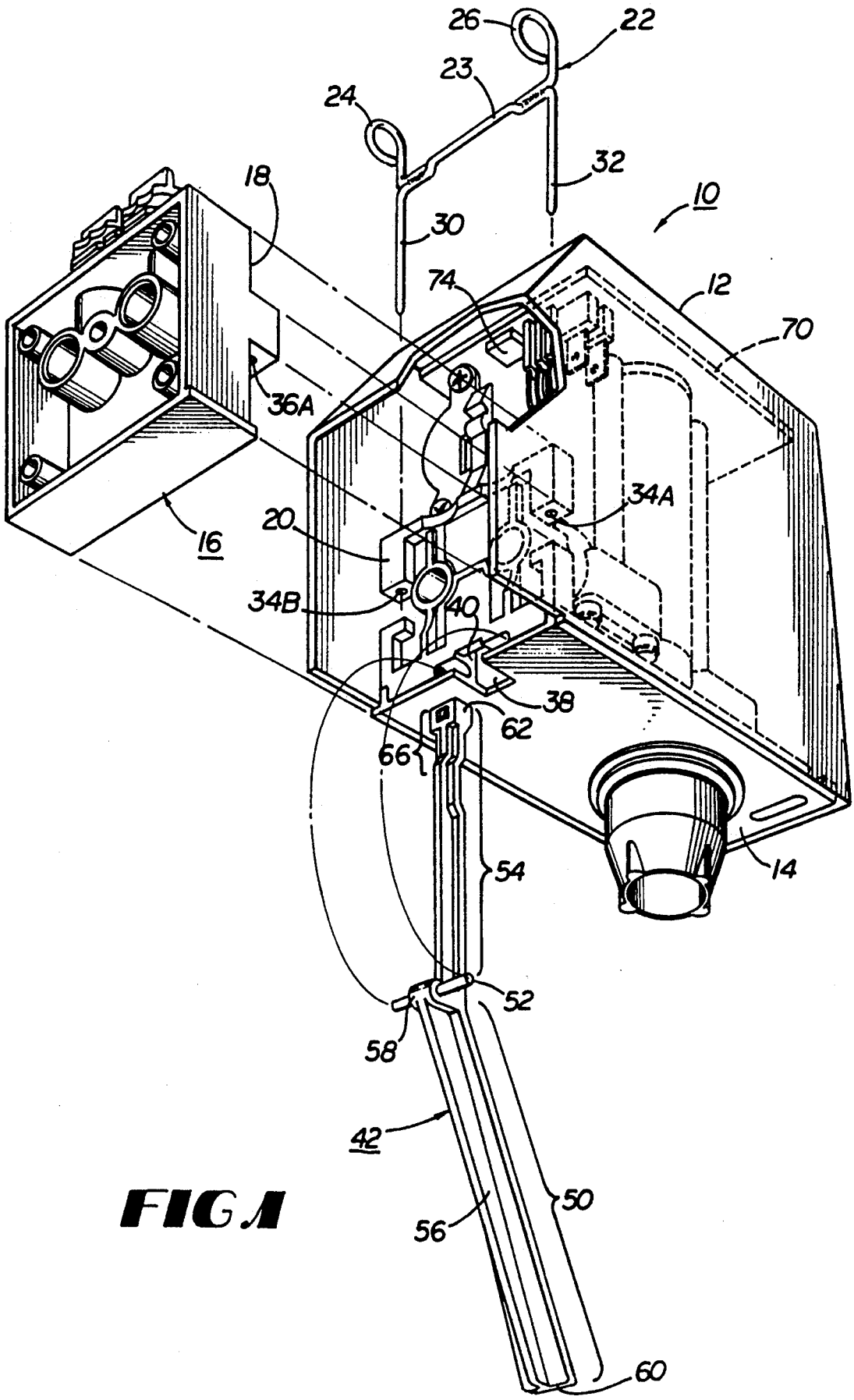
FIG. 1 is an exploded rear right perspective view of a beverage dispensing valve showing the lever arm of the present invention.
Figure 2:
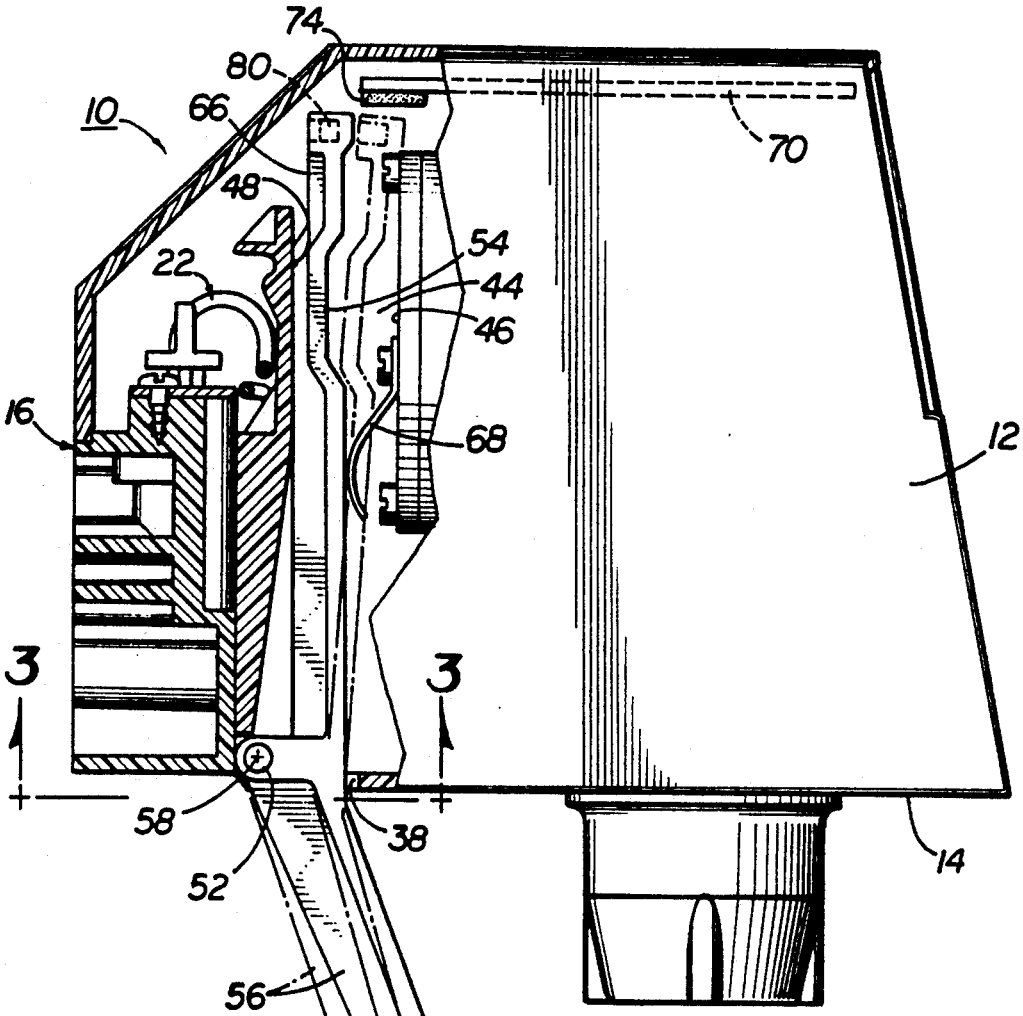
FIG. 2 is a partial side view of the dispensing valve of FIG. 1.
Figure 3:
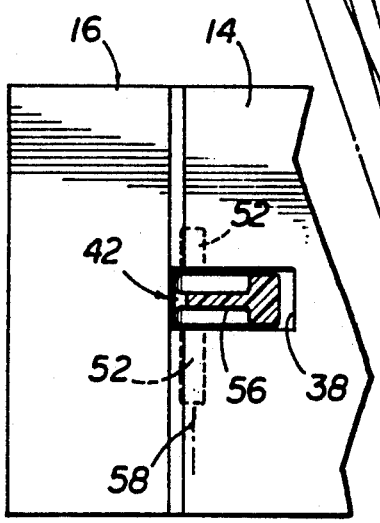
FIG. 3 is a fragmentary bottom plan view taken along lines 3—3 in FIG. 2.

Referring to FIG. 1–FIG. 3, there is illustrated the preferred embodiment of a beverage dispensing valve 10. A valve housing including a cover 12 and bottom plate 14 encloses the valve 10. The valve 10 is removably attached to a beverage dispenser, which is not shown, by a mounting block 16. The front wall 18 of the mounting block 16 fits into the rear wall 20 of the valve 10. A retaining wire 22 including pins 24 and 26, cross-piece 28 and rings 30 and 32, is provided for removably attaching the valve 10 to the mounting block 16. The rings 30 and 32 and cross-piece 28 allow the retaining wire 22 to be easily grasped in order to remove or insert the pins 24 and 26 into openings 34A and 34B in the valve 10 and openings 36A and 36B in the mounting block 16. An opening 38 is provided in the rear of the bottom plate 14 which is in communication with an inverted t-shaped opening 40 of the lower rear wall 20 of the valve 10 for the insertion of a lever arm 42 into a lever arm chamber 44 formed by a front surface 46 and a rear surface 48 in the valve 10. The lever arm 42 is a integrally formed elongated member comprising a lower cup contacting portion 50, pivot pin 52 for allowing the lever arm 42 to pivot front to back when the lever arm 42 receives a cup, and an upper switch actuating portion 54. The lever arm 42 is preferably made of glass reinforced nylon, which allows it to flex slightly when inserted into the valve to insure proper positioning of the lever arm. The cup contacting portion 50 of the lever arm 42 is provided with a tapered central rib 56 which extends from a pivot point 58 to the base 60 of the lever arm 42 providing increased strength. The pivot pin 52 is mounted on the pivot point 58 and allows the lever arm 42 to pivot in response to pressure applied to the cup contacting portion of the lever arm 50. The switch actuating portion 54 of the lever arm 42 extends upwardly from the pivot point 58 to a holding means 62. A central rib 64 extends from the pivot point 58 to the holding means 62 to provide increased strength to the lever arm 42. The uppermost portion of the rib 66 and lever arm 42 are indented to provide for clearance when inserted into the valve 10. The inverted t-shaped opening 40 receives the pin 52 of the lever arm 42. A leaf spring 68 helps position the lever arm 42, allowing it to return to its original position after being depressed. An electronic circuit board 70, which may take various forms, is mounted on top of a solenoid (not shown). A switch 72 using a Hall Effect sensor 74 is attached to the lower surface 76 of the circuit board.

Figure 4:
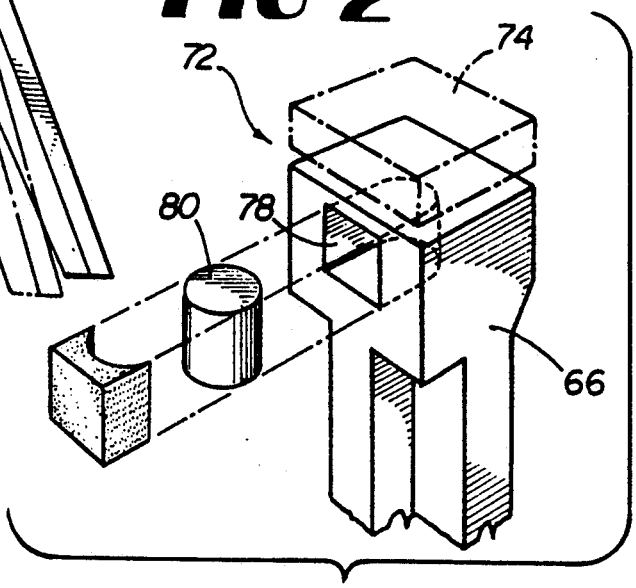
FIG. 4 is an exploded view of the switch mechanism located in the lever arm of the present invention.

As shown in FIG. 4, the holding means 62 of the switch actuation portion 54 of the lever arm 42 includes a central recess 78 for accommodating a magnet 80. The magnet 80 is secured in the central recess 78 by epoxy. The magnet 80 generates a magnetic field which is sensed by the Hall Effect sensor 74 whenever the magnet 80 comes within a certain distance of the sensor 74.

The leaf spring 68 is mounted on the front surface 46 of the lever arm chamber 44 and biases the holding means 62 and indented portion of the switch actuating portion 54 of the lever arm 42 against the rear wall 48 of the valve 10 out of range of the sensor 74. When a cup is pushed against the cup contacting portion 50 of the lever arm 42, the lever arm 42 pivots, placing the magnet 80 in close proximity to the sensor 74. In response to this close proximity, the magnetic switch 72 closes and energizes the solenoid beginning the dispense cycle. When the cup is removed from the cup contacting portion 50 of the lever arm 42, the leaf spring 68 causes the switch actuating portion 54 of the lever arm 42 to pivot back to its original position. The magnet 80 moves out of range of the sensor 74, causing the switch 72 to open, stopping the dispensing cycle.

In order to replace or remove the lever arm 42, a field technician would remove the face plate of the cover 12 and remove a screw or rotate a retaining finger allowing the cover 12 to be lifted off. He would then pull out the retaining wire 22 from the mounting block 16, separating the valve 10 from the mounting block 16. He would then grasp the cup contacting portion 50 of the lever arm 42, flexing it slightly. The pin 52 would then slip out of the t-shaped opening 40, allowing the lever arm 42 to be removed from the lever arm chamber 44. The switch actuating portion 54 of a new lever arm would then be inserted through the opening 38 and into the lever arm chamber 44. Pressure would then be applied in a rearward direction to the cup contacting portion 50 of the new lever arm, causing the entire lever arm to flex slightly. In response to this flexing motion, the pin 52 can be located in the t-shaped opening 40 in the rear valve wall 20. The valve 10 would then be reattached to the mounting block 16 by reinsertion of the retaining wire 22, thus completing the capture of the pin 52 and the cover 12 would be reapplied.

Figure 5:
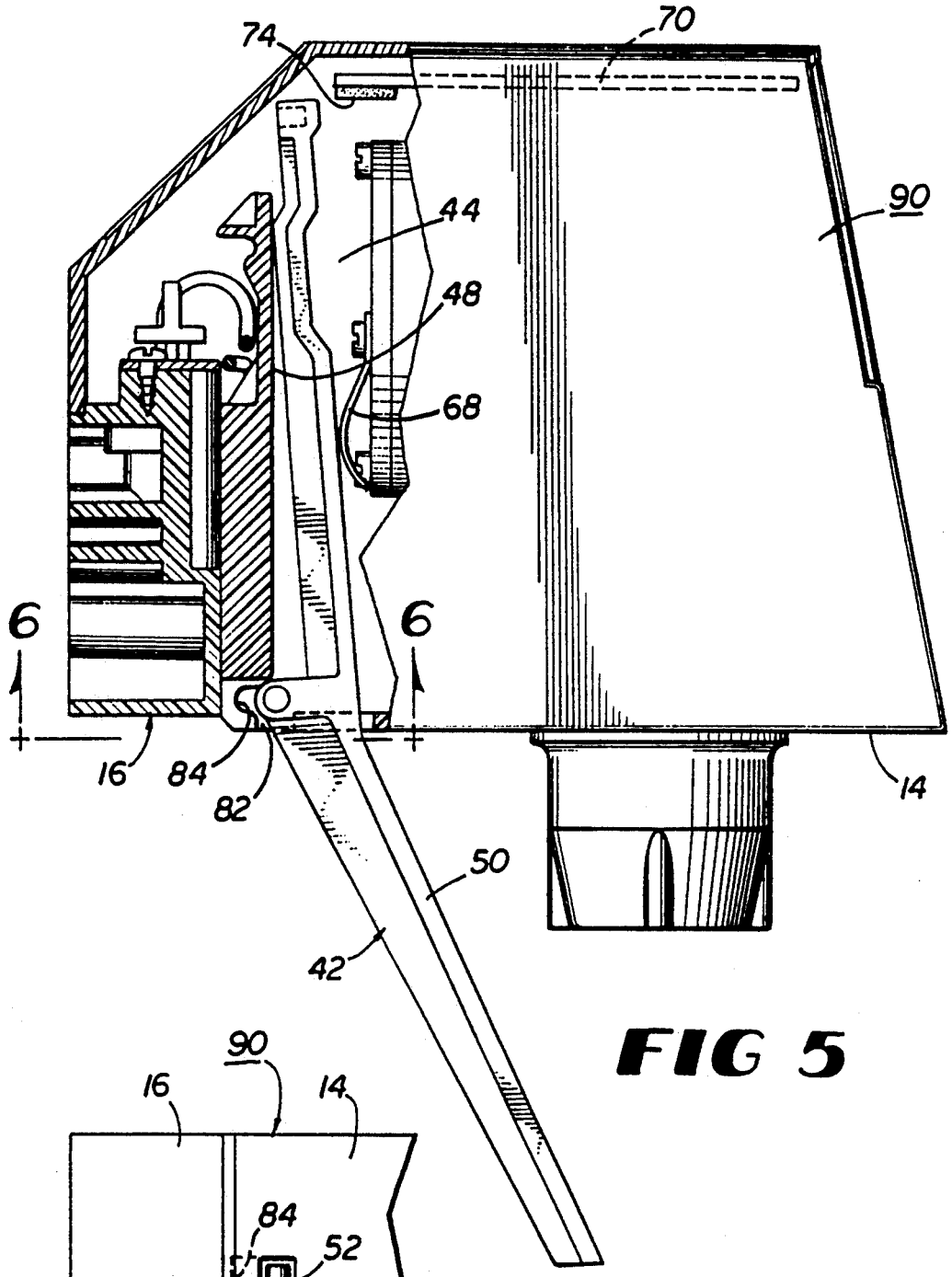
FIG. 5 is a partial side view of an alternate embodiment of the present invention.
Figure 6:
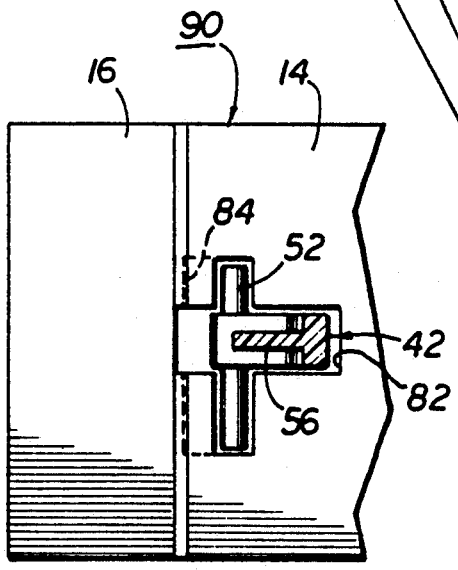
FIG. 6 is a fragmentary bottom plan view taken along lines 6—6 in FIG. 5.

FIGS. 5 and 6 show an alternate embodiment of a beverage dispensing valve 90 which does not require the removal of the valve cover 12 and valve 90 from the mounting block 16 in order to replace the lever arm 42. To remove the lever arm 42, the cup contacting portion 50 is pulled in a forward direction until the pin 52 lines up with a t-shaped opening 92 in the bottom plate 14. The lever arm 42 can then be pulled down and out of the lever arm chamber 44 through the t-shaped opening 92. To insert a lever arm into the valve 90, the switch actuating portion 54 of the lever arm is inserted through the t-shaped opening 92 into the lever arm chamber 44, compressing the leaf spring 68. As the lever arm is released, the pin 52 moves rearwardly to seal in a semicylindrical socket 94. The leaf spring 68 expands outwardly and maintains the lever arm in its rotatable position in the socket 94.

Figure 7:
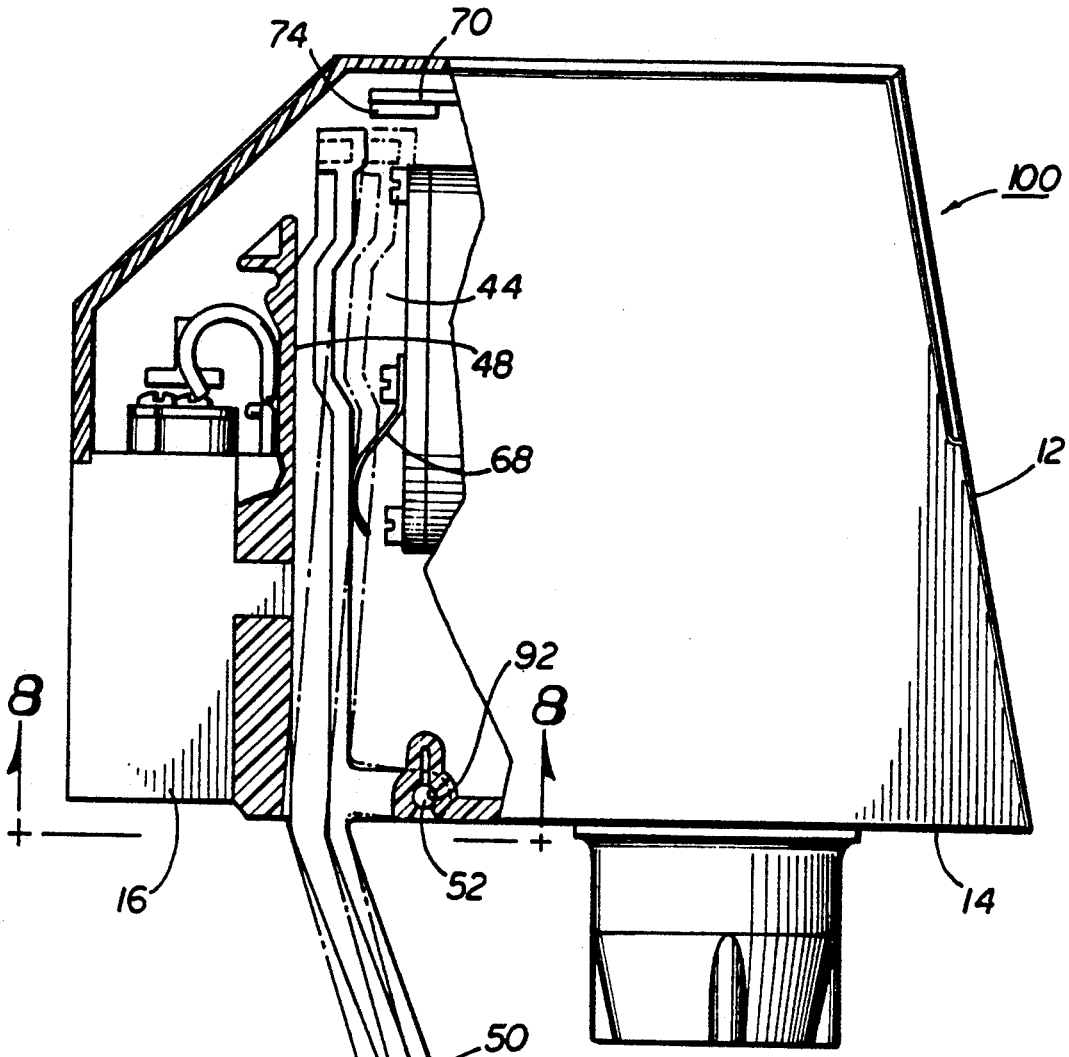
FIG. 7 is a partial side view of another alternate embodiment of the present invention.
Figure 8:
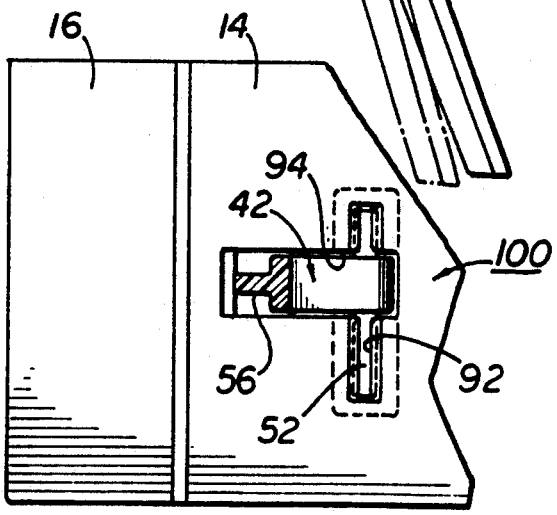
FIG. 8 is a fragmentary bottom plan view taken along lines 8—8 of FIG. 7.

FIGS. 7 and 8 show another embodiment of a beverage dispensing valve 100 which does not require the removal of the valve cover 12 and the valve 100 from the mounting block 16. To remove the lever arm 42, the cup contacting portion 50 is pulled downwardly causing the pin 52 to be released from a snap fit socket 102, and out of the lever arm chamber 44 through a t-shaped opening 104. To insert a lever arm, the switch actuating portion 54 is inserted into the lever arm chamber 44 through the t-shaped opening 104 until the pin 52 seats in the snap-fit socket 102, maintaining the lever arm 42 in its rotatable position. The leaf spring 68 biases the switching actuating portion 54 of the lever arm away from the Hall Effect sensor 74.

While the preferred embodiment of this invention has been described above in detail, it is to be understood that variations and modifications can be made therein without departing from the spirit and scope of the present invention. For example, the lever arm can be made of any alternate material which will not affect the magnet. The lever arm may be used with any type of valve or dispenser. The pin may vary in length in order to accommodate space constraints within the valve. The switch may be electrical or mechanical.

What is claimed is:

1. A lever arm assembly for a beverage dispensing valve comprising:

(a) a beverage dispensing valve including a housing including a cover and a bottom plate, switch means inside of said cover for turning said valve on to dispense a beverage, said housing enclosing a lever arm chamber having a front wall and a rear wall, and a lever arm connected to said valve and adapted to actuate said switch means;

(b) said lever arm being movable between a rest position in which said switch means is not actuated and an actuating position in which said switch means is actuated;

(c) means in said chamber for removably holding said lever arm to its rest position;

(d) said lever arm including a cup contact portion extending down below said valve, a pivot pin, and a switch actuating portion extending above said pivot pin and inside said cover;

(e) said valve housing including a lever arm opening large enough to allow said actuating portion and said pivot pin to be pushed up through said opening into said chamber, said valve including a lever arm chamber large enough to receive said actuating portion and to allow it to move freely when said lever arm moves between said rest and said actuating position; and (f) said valve including a pivot pin recess adjacent said opening adapted to receive and hold said pivot pin.

2. The apparatus as recited in claim 1 wherein said switch means is an electrical switch.

3. The apparatus as recited in claim 2 wherein said switch means is a Hall Effect sensor.

4. The apparatus as recited in claim 2 wherein said switch means is a microswitch.

5. The apparatus as recited in claim 1 wherein said holding means is a leaf spring.

6. The apparatus as recited in claim 1 wherein said pivot pin recess is a snap-fit groove.

7. The apparatus as recited in claim 1 wherein said means for removably holding said lever arm to said valve consists solely of said spring and said groove, and wherein said lever arm is easily and manually removable without tools.

8. A method for installing a lever arm on a beverage dispensing valve comprising:

(a) providing a beverage dispensing valve with a housing surrounding said valve and enclosing a lever arm chamber having a front surface and a rear surface for accommodating an upper portion of a lever arm, said housing including a lever arm opening into said chamber adapted to receive a lever arm therethrough and into said chamber, and switch means adjacent said chamber for turning said valve on to dispense beverage therefrom;

(b) a lever arm having a switch actuating portion inserted into said chamber and including an intermediately located pivot pin and a lower cup contact portion;

(c) said valve including spring means mounted on adjacent said front surface for biasing said switch actuating portion of said lever arm against said rear surface;

(d) said housing having a pivot pin-receiving groove adjacent said opening and said pivot pin being positioned in said groove and said lever arm being removably held in place in said valve solely by said spring and groove such that said lever arm can be easily removed from said valve;

(e) said lever arm being pivotably movable between a rest position and an actuating position, said switch actuating portion moving against said spring means and toward said front surface in said actuating portion; and (f) said upper portion of said lever arm having means for actuating said switch means when said lever arm is in its actuating position.

9. The apparatus as recited in claim 8 including snapping said pivot pin into said groove.

10. The apparatus as recited in claim 8 including removing said lever arm by simply moving said lever arm away from said groove to pull said pivot pin out of said groove and then pulling said lever arm out said opening.

* * * * *